US005103845A

United States Patent [19]

Matthews

[11] Patent Number: 5,103,845

[45] Date of Patent: Apr. 14, 1992

[54] MANICURE SHIELD

[76] Inventor: Lynn M. Matthews, 1676 Glenshire, Canton, Mich. 48188

[21] Appl. No.: 607,318

[22] Filed: Oct. 31, 1990

[51] Int. Cl.[5] ..... A45D 29/00

[52] U.S. Cl. ..... 132/73

[58] Field of Search ..... 132/73, 73.5, 319, 333, 132/285

[56] References Cited

U.S. PATENT DOCUMENTS

| | | | |
|---|---|---|---|
| 2,218,296 | 10/1940 | Perras | 132/73 |
| 2,378,935 | 6/1945 | Kraft | 132/73 |
| 2,807,270 | 9/1957 | Patterson | 132/285 |
| 4,967,775 | 11/1990 | Kaiser | 132/73 |

FOREIGN PATENT DOCUMENTS

| | | | |
|---|---|---|---|
| 201107 | 11/1986 | European Pat. Off. | 132/73 |
| 303794 | 2/1989 | European Pat. Off. | 132/73 |

*Primary Examiner*—Gene Manciene
*Assistant Examiner*—Michael Lynch
*Attorney, Agent, or Firm*—Lynn E. Cargill

[57] ABSTRACT

A manicure shield for restraining loose sculptured nail chips to protect a manicurist and a customer which includes a free-standing enclosure having a first opening in the rear of the enclosure sized to allow the passage of the customer's hand and a second opening in the front of the enclosure sized to permit manicuring of the customer's fingernails by the manicurist, where the free-standing enclosure is structured such that free-flying chips produced during the manicuring operation are shielded from the faces and bodies of the customer and manicurist. The manicure shield can be, for example, an accordion-like collapsible design or a box-like foldable design.

13 Claims, 1 Drawing Sheet

MANICURE SHIELD

TECHNICAL FIELD

This invention relates generally to devices to assist in manicuring activities and more particularly relates to a manicure shield which protects the customer and the manicurist from flying pieces of sculptured nails.

BACKGROUND OF THE INVENTION

In the field of nail care, resinous nail products, such as those made of acrylic, are used to prepare what is called "sculptured fingernails", which are artificial polymeric fingernails formed on and adhered to the natural nails. These sculptured nails are typically longer and more beautiful than the person's natural nails and are capable of being painted with fingernail polish or left natural. Since the polymeric nail is firmly attached to the fingernail, it moves with natural nail growth. Consequently there is, therefore, a gap formed at the base of the natural nail free of the polymeric nail. This gap is periodically patched with new material by the manicurist. At the time of patching or repairing the sculptured nails (also called "filling"), the end of the sculptured nail near the base of the fingernail is often lifted off the natural nail in an unbecoming fashion. Furthermore, there is a danger of mold and fungus growing underneath the nail which has become unattached, as well as the possibility of the polymeric nails breaking away from the fingernail. Wet conditions are conducive to such growth. Therefore, all loose nail portions must be removed to alleviate the probability of such fungus or mold growth and also they provide a clean surface for applying the new nail material.

The manicurist, at the time of repairing the sculptured nail, will first clip the polymeric nail at the lifted end to smooth the surface in preparation for applying additional polymeric material. The sculptured nail, being hard and of low flexibility, often flies outwardly with great force when clipped. These free-flying pieces of material have been known to fly in the faces or at the bodies of the customer and the manicurist, sometimes causing injury. Eye injuries and subsequent eye infections have been known to be caused by flying pieces of nail.

To guard against possible eye injury caused by these free-flying pieces, the customer and/or manicurist have been known to wear safety goggles. However, safety goggles presents a problem when the goggles smear the wearer's eye makeup. In addition, the goggles do nothing to protect the rest of the wearer's face or body and do nothing to protect bystanders from flying chip of nails.

Relevant products in the manicuring field are found described in U.S. Pat. Nos. 4,289,152, 4,359,060, and 4,742,836. U.S. Pat. No. 4,289,152 issued to Fuhre on Sept. 15, 1981, discloses a fingernail cleaning apparatus which includes a housing with an aperture for inserting a finger. The apparatus also includes a nozzle member which provides an edge for pushing back the skin at the tip of the finger so that pressurized liquid from a pump can be directed against the inside surface of the nail instead of being deflected by the skin.

U.S. Pat. No. 4,359,060 issued to Walker on Nov. 16, 1982, discloses an apparatus for dispensing nail polish and remover from the bottles of same without spilling the contents over rugs, clothes or furniture. The apparatus is comprised of a housing residing atop a base, the housing having two opposed side walls, the remaining sides being open to allow access to the bottles which are held within pivotally mounted receptacles on the interior of the side walls.

U.S. Pat. No. 4,742,836 issued to Buehler on May 10, 1988, discloses a fingernail device which includes a receptacle having a small diameter fluid passageway positioned at an angle to the base of the receptacle. The passageway has a nozzle which directs fluid at a downward angle to the upper surface of the base of the receptacle. Joined to the upper surface of the base of the receptacle is a fluid deflector. The deflector acts to intercept any cleaning fluid which may splash from, or spray out from the receptacle. None of these above-described patents is directed at shielding people from flying pieces of sculptured nails.

It is a primary object of the present invention to provide a manicure shield in accordance with the present invention which protects the customer, manicurist, and any on-lookers from flying pieces of sculptured nails clipped from the customer's nails.

It is another object of the present invention to provide a manicure shield which rests securely on a flat surface, is easy to assemble and can be assembled before the customer arrives, and can be made to be easily disassembled into a relatively flat piece for storage.

SUMMARY OF THE INVENTION

In accordance with the preferred embodiment of the invention, these and other objects and advantages are addressed as follows. A manicure shield capable of protecting people from flying pieces of sculptured nail chips includes a free-standing enclosure having a first opening in the rear of the enclosure sized to allow the passage of the customer's hand and a second opening in the front of the enclosure sized to permit manicuring of the customer's fingernails by the manicurist where the free-standing enclosure is structured such that free-flying chips produced during the manicuring operation are shielded from the faces and bodies of the customer and manicurist.

In another embodiment of the present invention, a manicure shield is disclosed which includes an accordion-like structure including a skeleton of ribs for supporting flexible material where the structure is substantially semi-spherically-shaped when expanded and flat when collapsed and has a hinge at either extremity of the skeletal ribs for permitting opening and closing of the accordion structure. This embodiment rests securely on a flat surface, is easy to assemble, can be assembled before the customer arrives, and can be easily collapsed into a flat piece for storage.

In yet another embodiment of the invention, a manicure shield is disclosed which is a box-like configuration having triangular sides, a rectangular back, and an upper rectangular flap downwardly projecting from the apexes of the triangular sides, wherein the triangular sides and the upper rectangular flap are hinged to the rectangular back. This embodiment also rests securely on a flat surface, is easy to assemble, can be assembled before the customer arrives, and can be easily collapsed into a flat piece for storage.

BRIEF DESCRIPTION OF THE DRAWINGS

The nature and extent of the present invention will be clear from the following detailed description of the particular embodiments thereof, taken in conjunction with the appendant drawings, in which.

DETAILED DESCRIPTION OF THE INVENTION

Figure 1:
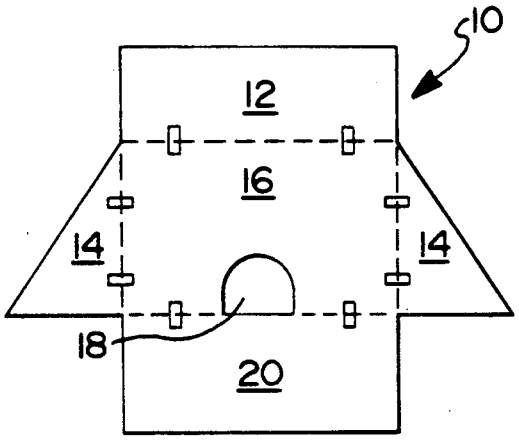
FIG. 1 shows a plan view of box-type manicure shield 10 before assembly constructed in accordance with the present invention.
Figure 2:
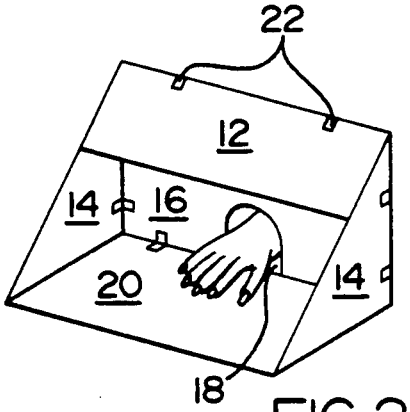
FIG. 2 shows a perspective view of box-type manicure shield 10 of FIG. 1 fully assembled with a customer's hand projecting through opening 18.

Referring first to FIG. 1, a box-type manicure shield 10 is shown in the unfolded disassembled state. Manicure shield 10 has rectangular back 16 having a semi-circular opening 18, triangular sides 14, upper rectangular flap 12, and rectangular bottom 20. Triangular sides 14, upper flap 12, and bottom 20 are each attached to rectangular back 16 with hinges 22, for example, flexible hinges such as those formed of cloth tape.

Manicure shield 10 is prepared for use by folding triangular sides 14 inwardly, folding bottom 20 upwardly, and folding top flap downwardly to rest on folded-in triangular sides 14. A customer's hand is shown projecting through opening 18. The front opening defined by triangular sides 14 bottom 20 and upper flap 12 is the opening into which the manicurist can insert his/her hand and work with the customer's hand. The front opening is preferably from about 3 to about 10 times larger than opening 18. Bottom 20 is optional for this invention as manicure shield 10 would rest securely on a flat surface by the bottom edges of back 16 and triangular sides 14. The inclusion of bottom 20, however, provides a surface for catching many of the dropped pieces of sculptured nails. With or without bottom 20, manicure shield 10 is considered "free-standing" in that it independently rests securely on a flat surface without rolling or toppling over. Back 16, sides 14, and top flap 12 effectively shield the customer, manicurist and other people from flying pieces of clipped sculptured nails. Top flap 12 angularly projecting down in the direction of the manicurist, especially effectively shields the manicurist from flying pieces of nail. Manicure shield 10 is preferably formed of a transparent, rigid and tough material such as LUCITE. The transparency allows the manicurist and customer to easily see the work area and manicuring activities.

Figure 3:
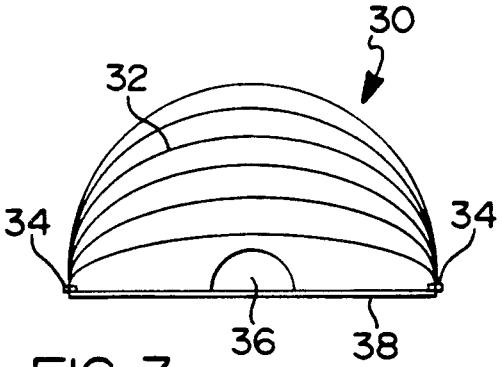
FIG. 3 shows the back side view of another embodiment of the inventive device where manicure shield 30 is an accordion-like structure.
Figure 4:
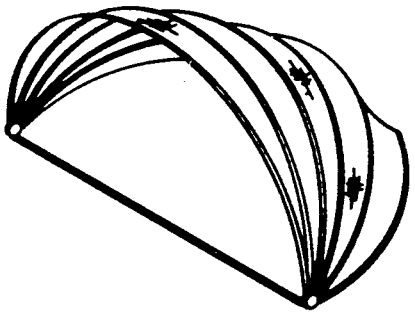
FIG. 4 shows a perspective view of manicure shield 30 of FIG. 3.

FIG. 3 depicts another embodiment of the invention, accordion-like manicure shield 30 having a skeleton of semi-circular ribs 32 which are hinged at hinges 34 on each end of the ribs. Manicure shield 30, also free-standing, has a semi-circular opening 36 at the rear side for insertion of a customer's hand. Skeleton of ribs 32, formed of, for example, metal, supports flexible material 40 which is formed of, for example, fine-screen mesh or transparent cloth. The flexible material may be glued or otherwise attached to the ribs. Skeleton of ribs 32, when expanded as shown, forms a semi-spherical shape leaving a second opening in manicure shield 30 for the insertion of the manicurist's hands for working on the customer's hand inside the enclosure defined by manicure shield 30. The second opening is preferably from about 3 to about 10 times larger than the opening at the back of the shield. Shown at the base of manicure shield 30 is optional flat bottom 38 upon which the manicure shield rests and which can catch dropped pieces of sculptured nails. Each consecutive rib of the skeleton of ribs 32 is sized slightly smaller than the previous rib so that skeleton of ribs 32 is collapsible to a flat piece (not shown). FIG. 4 shows the reverse side of the device of FIG. 3. In an alternative design, the ribs of the skeleton may be of the same size, so that when the accordion-like structure is collapsed, the ribs stack up. In this design, the collapsed form is still relatively flat and uses little space.

Figure 5:
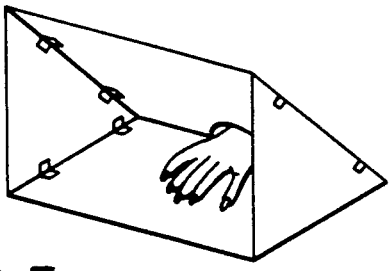
FIG. 5 shows a perspective view of another design of the manicure shield.

FIG. 5 illustrates yet another design of the manicure shield without an upper shield piece. In addition, I also envision a similar design in which a forward slanting shield piece may be inserted into a wooden block such that a hand may be inserted therethrough. This embodiment may not include any sides.

Thus, there is provided in accordance with the present invention, a manicure shield which protects people, e.g., the customer and the manicurist, from flying pieces of rigid polymeric sculptured nails. The shield reduces the injuries and annoyances cause by fast-flying pieces of plastic. The manicure shield of this invention is easily manufactured, easy to assemble and disassembles to a flat piece by collapsing or folding for storage. The shield rests securely on a flat surface, such as a manicurist's table, without rolling or toppling over, and the shield may be assembled before the customer arrives so that the customer only has to insert his/her hand into the opening and does not have to wait for assembly.

While my invention has been described in terms of a specific embodiment, it must be appreciated that other embodiments could readily be adapted by one skilled in the art. Accordingly, the scope of my invention is to be limited only by the following claims.

I claim:

1. A manicure shield for restraining loose sculptured nail chips to protect a manicurist and a customer, comprising:

a free-standing enclosure having an accordion-like structure formed in part of flexible material which enables the structure to be collapsed for storage with a first opening in the rear of the enclosure sized to allow the passage of the customer's hand and a second opening in the front of the enclosure sized to permit manicuring of the customer's fingernails by the manicurist, said free-standing enclosure structured such that free-flying chips produced during the manicuring operation are shielded from the faces and bodies of the customer and manicurist.

2. A manicure shield for restraining loose sculptured nail chips to protect the manicurist and her customer, comprising:

an accordion-like structure including a skeleton of ribs for supporting flexible material, said structure being substantially semi-spherically-shaped when expanded and flat when collapsed and having a hinged end at either extremity of the skeletal ribs for permitting opening and closing of the accordion structure, said accordion-like structure having a first opening in the rear of the structure sized to allow the passage of the customer's hand and a second opening in the front of the structure sized to permit manicuring of the customer's fingernails by the manicurist, said accordion-like structure formed such that free-flying chips produced during the manicuring operation are shielded from the faces and bodies of the customer and the manicurist.

3. The manicure shield of claim 2, wherein said first opening in the rear of the accordion-like structure is semi-circularly-shaped.

4. The manicure shield of claim 2, wherein said second opening in the front of said accordion-like structure is from about 3 to about 10 times larger than said first opening.

5. The manicure shield of claim 2, wherein said accordion-like structure includes mesh material supported between said skeleton of ribs.

6. The manicure shield of claim 2, wherein said skeleton of ribs includes consecutively smaller concentric semi-circular ribs which nest one within another to provide a flat structure when collapsed.

7. The manicure shield of claim 2, further comprising a flat bottom attached to the skeleton of ribs.

8. The manicure shield of claim 2, wherein said skeleton of ribs includes a plurality of equally-sized semi-circular ribs which stack up when said shield is in a collapsed form.

9. A manicure shield for restraining loose sculptured nail chips to protect the manicurist and her customer, comprising:

a box-like configuration having triangular sides, a rectangular back and an upper rectangular flap downwardly projecting from the apexes of the triangular sides, wherein said triangular sides and said upper rectangular flap are hinged to said rectangular back, said box-like configuration having a first opening in said rectangular back sized to allow the passage of the customer's hand and a second opening in the front of the configuration sized to permit manicuring of the customer's fingernails by the manicurist, said configuration structured such that free-flying chips produced during the manicuring operation are shielded from the faces and bodies of the customer and the manicurist.

10. The manicure shield as in claim 9, wherein said first opening in the rectangular back is semi-circularly shaped.

11. The manicure shield as in claim 9, wherein said second opening in the front of the configuration is from about 3 to 10 times larger than said first opening.

12. The manicure shield as in claim 9, wherein said box-like configuration is formed primarily of a transparent material.

13. The manicure shield as in claim 9, wherein said box-like configuration further comprises a flat bottom hingedly attached to said rectangular back.

* * * * *